US006119667A

United States Patent [19]

Boyer et al.

[11] Patent Number: 6,119,667

[45] Date of Patent: Sep. 19, 2000

[54] INTEGRATED SPARK PLUG IGNITION COIL WITH PRESSURE SENSOR FOR AN INTERNAL COMBUSTION ENGINE

[75] Inventors: James Alva Boyer; Jeffrey Dan Ogden; James Tordt Wright, all of Anderson, Ind.

[73] Assignee: Delphi Technologies, Inc., Troy, Mich.

[21] Appl. No.: 09/359,188

[22] Filed: Jul. 22, 1999

[51] Int. Cl.[7] ..... F02P 11/00

[52] U.S. Cl. ..... 123/634; 123/647; 123/169 R; 315/57; 73/35.12

[58] Field of Search ..... 123/634, 647, 123/169 R, 435, 406.41; 315/57, 134, 35.12; 73/35.07

[56] References Cited

U.S. PATENT DOCUMENTS

| | | | |
|---|---|---|---|
| 4,751,430 | 6/1988 | Muller et al. | 123/634 |
| 4,903,674 | 2/1990 | Bassett et al. | 123/634 |
| 5,111,790 | 5/1992 | Grandy | 123/634 |
| 5,411,006 | 5/1995 | Noble et al. | 123/634 |
| 5,672,812 | 9/1997 | Meyer | 73/35.07 |
| 5,904,127 | 5/1999 | Kemmler et al. | 123/435 |

*Primary Examiner*—Erick Solis
*Attorney, Agent, or Firm*—Margaret A. Dobrowitsky

[57] ABSTRACT

An ignition coil, spark plug, and pressure sensor for an internal combustion engine are integrated into a single assembly and mounted directly on a plug hole of an internal combustion engine. A hard spark plug shell serves as a magnetostrictive section for pressure detection. A radially polarized biasing magnet is disposed adjacent the spark plug shell thereby generating an initial flux through a sensing winding. The sensing winding is wound about the lower end of the coil case to sense changes in the induction characteristics of the spark plug shell as a result of pressure changes in the cylinder. A first passive method of sensing pressure whereby the flux change due to the permeability change generates a signal voltage in the sensed coil. This voltage is proportional to the time rate of change of pressure which is integrated to produce a cylinder pressure waveform. A second active method employs an oscillator to drive the sensing circuit with a frequency at least ten times that of the pressure signal content. The frequency or amplitude of this signal is then modulated in response to the induction property change of the spark plug shell the induction changes The second method is capable of detecting both static and dynamic pressure.

8 Claims, 3 Drawing Sheets

INTEGRATED SPARK PLUG IGNITION COIL WITH PRESSURE SENSOR FOR AN INTERNAL COMBUSTION ENGINE

TECHNICAL FIELD

The present invention relates to an integrated spark plug coil with a pressure sensor, and more particularly to a such a device formed in a single compact unit.

BACKGROUND OF THE INVENTION

An ignition coil for an internal combustion engine that is installed directly on an engine and that is directly coupled with spark plugs is known. However, these prior art ignition coils/spark plugs do not incorporate a pressure sensor and often are large and costly to produce. A pressure sensor mounted on a spark plug is also known as disclosed in U.S. Pat. No. 5,672,812 to Meyer and is incorporated herein by reference. However, hereto for, the prior art does not disclose an integrated spark plug, coil and pressure sensor.

The '812 to Meyer discloses a magnetostrictive pressure sensor device attached to a spark plug shell. However, this arrangement does not disclose a production feasible apparatus since it fails to address the important issue of packaging, signal lead routing, and suppression of engine noise pick-up. Moreover, the '812 reference does not incorporate a coil to charge the spark plug nor a means to energize the sensing winding.

SUMMARY OF THE INVENTION

To solve problems of the prior art such as the foregoing, the present invention provides an integrated spark plug, ignition coil, and pressure sensor within a single unit. An ignition coil and pressure sensor for an internal combustion engine is housed within a plug hole of an engine and mounted directly to the engine. The hard spark plug shell serves as a magnetostrictive section. A radially polarized biasing magnet is disposed adjacent the spark plug shell thereby generating an initial flux through a sensing winding. The sensing coil is wound about the lower coil case to sense changes in the induction characteristics of the spark plug shell as a result of pressure changes in the cylinder. A first passive method of sensing pressure whereby the flux change due to the permeability change generates a signal voltage in the sensed coil. This voltage is proportional to the time rate of change of pressure which is integrated to produce a cylinder pressure waveform. A second active method employs an oscillator to drive the sensing winding with a frequency at least ten times that of the pressure signal content. The frequency or amplitude of this signal is then modulated in response to the induction property change of the spark plug shell. These induction changes are sensed by the sensing winding. The second method is capable of detecting both static and dynamic pressure.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENT

Figure 1:
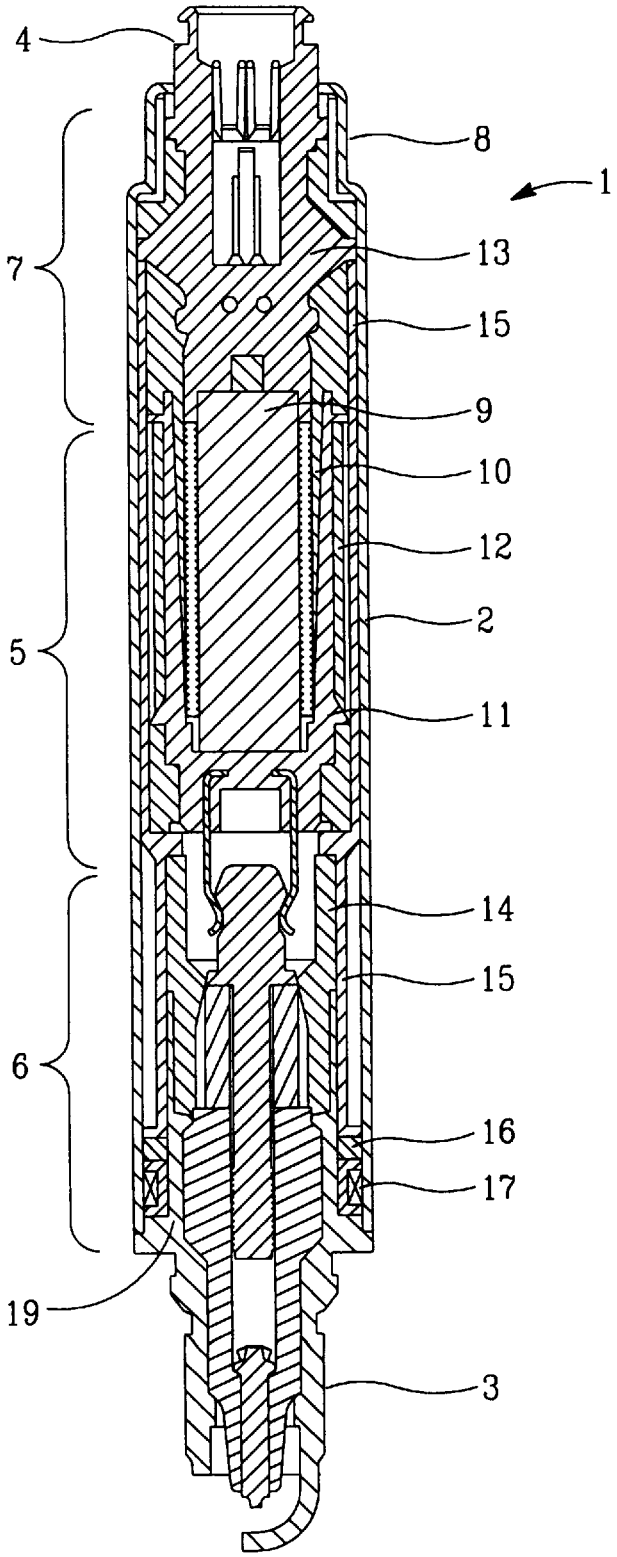
FIG. 1 is a sectional view of the integrated spark plug coil with pressure sensor according to the present invention.

The preferred embodiments of the present invention are hereinafter described with reference to the accompanying drawings. Referring to the figures, and particularly to FIG. 1, a preferred embodiment of an integrated ignition coil, spark plug and pressure sensor assembly in accordance with the present invention is illustrated in partial sectional view and is generally designated by the reference numeral 1. The integrated ignition coil, spark plug, and pressure sensor assembly 1 is adapted for installation to a conventional internal combustion engine 22 through a spark plug shell and in threaded engagement with a spark plug opening 23 into a combustion cylinder.

The assembly has a substantially rigid outer housing 2 at one end of which is a spark plug assembly 3 and at the other end of which is a control circuit interface portion 4 for external electrical interface with the engine control unit 24. The assembly further comprises a substantially slender high voltage transformer including substantially coaxially arranged primary and secondary windings and a high permeability magnetic core. All high voltage ignition system components are housed or are part of the integrated ignition coil, spark plug, and pressure sensor assembly 1.

Generally, the structure is adapted for drop in assembly of components and sub-assemblies as later described.

As shown in FIG. 1, an ignition coil for an internal combustion engine is provided with a rigid outer housing 2 preferably composed of steel as a housing of the ignition coil. A transformer portion 5 and a control-circuit portion 7 as a coil portion for high-voltage generation are inserted in outer coil housing 2. The control-circuit portion 7 responds to instruction signals from an external circuit (not shown) to cause primary current of the transformer portion 5 to be intermittent. It is noted that the control circuit may be external to the integrated coil/spark plug assembly. A connecting portion 6 which supplies secondary voltage inducted from the transformer portion 5 to the spark plug 3 is provided in a lower portion which is another end of the outer coil housing 2.

The outer housing 2 may be formed from round tube stock preferably comprising nickel-plated 1008 steel or other adequate magnetic material. Where higher strength may be required, such as for example in unusually long cases, a higher carbon steel or a magnetic stainless steel may be substituted. A portion of the outer housing 2 at the end adjacent the control circuit interface portion 4 is preferably formed by a conventional swage operation to provide a plurality of flat surfaces to provide a fastening head 8, such as a hexagonal fastening head for engagement with standard sized drive tools. Additionally, the extreme end is rolled inward to provide necessary strength for torque applied to the fastening head 8 and perhaps to provide a shelf for trapping ring clip between the outer housing 2 and the connector body 4. The previously assembled primary and secondary sub-assemblies are loaded into the outer housing 2 from the spark plug end to a positive stop provided by the swaged end acting on a top end portion of the connector body.

The transformer portion 5 is formed around a central magnetic core 9. The magnetic core 9 of the transformer portion 5 may be manufactured from plastic coated iron particles in a compression molding operation. After the core 9 is molded, it is finish machined such as by grinding to provide a smooth surface absent for example sharp mold parting lines otherwise detrimental to the intended direct primary coil winding thereon.

Laminating thin silicon-steel plates of differing widths so that a cross section thereof becomes substantially circular may also form the core 9. Magnets having polarity of reversed directions of magnetic flux generated by excitation by the coil are disposed respectively on both ends of this iron core 9.

The primary coil 10 is wound directly on the surface of the molded core 9. The windings are formed from insulated wire, which are wound directly upon the outer cylindrical surface of the core 9. The primary coil 10 may comprised two winding layers each being comprised of 127 turns of No. 23 AWG wire. Adhesive coatings, though not foreseeably needed, may be applied to the primary coil 10 such as by conventional felt dispenser during the winding process or by way of an injection of liquid silicone rubber about the wire. The winding of the primary coil 10 directly upon the core 9 provides for efficient heat transfer of the primary resistive losses and improved magnetic coupling which is known to vary substantially inversely proportionally with the volume between the primary winding and the core. The core 9 is preferably assembled to the interior end portion of the connector body to establish positive electrical contact between the core 9 and the core-grounding terminal. However, the specific grounding of the core is not essential to the operation of the present invention. The terminal leads of primary coil 9 are connected to the insert molded primary terminals by soldering.

The primary sub-assembly is inserted into the secondary spool 11. A secondary coil 12 is wound onto the outer periphery of the secondary spool 11. The secondary coil may be either a segment wound coil or a layer wound coil in a manner that is known in the art.

The control-circuit portion 7 is preferably made up of a molded-resin switching element which causes conduction current to the primary coil to be intermittent, and a control circuit which is an igniter that generates the control signals of this switching element. Additionally, a heat sink, which is a separate body, may be glued to the control-circuit portion 7 for heat radiation of circuit elements such as the switching element. However, as previously mentioned, the control-circuit portion 7 may be external to the spark plug assembly. Furthermore, in an alternate embodiment, the pressure sensor may be integrated with a spark plug assembly with an external control circuit portion and coil package.

The interior of the outer housing 2 houses the transformer portion 5, connector portion 13, and a high voltage boot 14.

A coil case 15 is disposed within the outer housing 2 added for support and to support the coil and pressure sensing components.

For the assembly process, the wound primary coil 10 with assembled connector 13 is assembled to the wound secondary spool 11 and then into the coil case 15.

The above-described ignition coil is inserted in a plug hole of an internal combustion engine and is fixed to an engine. A spark plug 3 mounted on a bottom portion of the plug hole is received within the connecting portion 6, and a head-portion electrode of the spark plug electrically contacts an end portion of the transformer portion 5. The steel case on the coil is preferably welded to the spark plug to form a pre-assembled unit. The pre-assembled unit is then screwed into the spark plug hole in the engine head in the conventional manner. The unit is self-supporting with no attachment bolts required.

It is preferable that the ignition coil have a cross-sectional configuration and dimensions that are housable within the plug hole 23. According to this embodiment, a tube-portion cross section of the outer coil housing 2 is formed to be circular so that an inner-diameter dimension accommodates a plug hole 23, and an outer diameter thereof is established to be a suitable dimension as recognized by those skilled in the art.

As previously mentioned the coil case 15 is disposed within the outer housing 2. The coil case 15 extends from the spark plug shell 3 to the circuit interface portion 4. The coil case 15 also contains the core 9, primary coil 10, secondary spool 11, and secondary coil 12. The pressure sensor assembly is disposed between the coil case 15 and outer housing 2 adjacent the spark plug shell. The pressure sensor assembly is comprised of an annular biasing magnet 16, a sensing winding 17, and a flex circuit 18 extending from the sensing winding 17 along the coil case 15 to the opposite end of the coil case to the circuit interface portion 4. The flex circuit is preferably comprised of a multi-layer circuit. A ground plane layer is disposed adjacent the coil case. Sensing winding leads are then disposed on subsequent outer layers sandwiched between insulating layers. The ground plane, together with the insulating layers protect the sensing winding leads from the high voltage of the coils and therefore reduces or eliminates noise coupling. The circuit interface portion 4 connects to the electrical system of the vehicle to both provide an electrical input and control of the coils, communication of the sensing winding to the engine control unit as well as connection to the oscillator as in the alternate embodiment.

A cylindrical portion of the spark plug shell 3, known as the magnetostrictive section 19, extends upward and within the coil case 15 and snugly engages the coil case 15. The sensing winding 17 wraps around the lower portion of the coil case 15 proximate the magnetostrictive portion 19 of the spark plug shell 3.

Figure 2A:
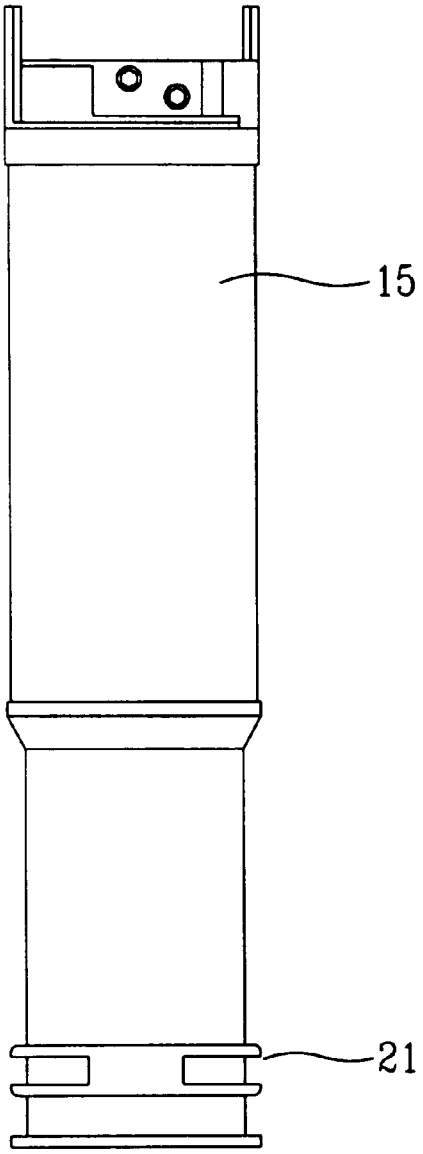
FIGS. 2A & 2B are side views of the coil case, biasing magnet and flex circuit of the integrated spark plug coil with pressure sensor of FIG. 1.
Figure 2B:
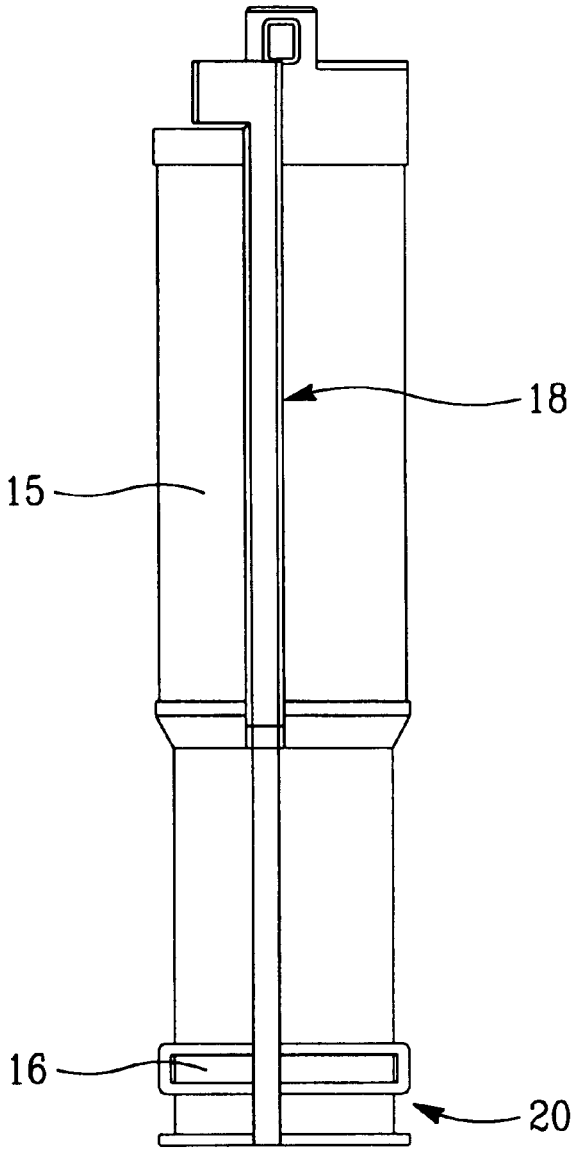

FIGS. 2A & 2B depict the coil case 15, biasing magnet 16, and flex circuit 18. On the lower portion of the coil case 15 is formed a winding bay 20, and a retainer portion 21. The sensing winding 17 is directly wound on the coil case 15 and preferably is wound around and disposed within the winding bay 20. The outer diameter of the winding bay 20 is preferably dimensioned to be equal to the inner diameter of the lower portion of the outer housing 2. Such provides a stable assembly and maintains the sensing winding 17 in close proximity to the magnetostrictive portion 19 of the spark plug shell 3. Just above the winding bay 2 is the retainer 21 adapted to receive and retain the biasing magnet 16. Preferably the biasing magnet 21 is annular and disposed within an annular groove formed in the outer peripheral surface of the coil case. In the preferred embodiment the magnetostrictive portion 19 of the spark plug shell 3 extends beyond both the sensing winding 17 and the biasing magnet 16. The leads of the sensing winding are connected to the appropriate lines of the flex circuit 18 which is adhered to the outer surface of the coil case 15 and extends to the circuit interface portion 4. As previously mentioned, a ground plane is built into the flex circuit 18 disposed between the coil case 15 and the sensing winding lead lines so that the low voltage signal is shielded.

The spark plug shell 3 and magnetostrictive section 19 together with the steel coil housing provide a magnetic path which is energized by the biasing magnet. The biasing magnet is radially polarized to produce an appropriate initial flux through the sensing winding. The magnetic flux flowing in this path is enclosed by the sensing winding 17. When the spark plug shell is stressed due to cylinder pressure, the induction characteristics of the spark plug shell 3 change. This change in induction characteristics can be detected by the sensing winding by two methods. In the preferred embodiment, the spark plug shell and magnetostrictive portion is made of a nickel alloy plated steel. Such material provides sufficient change in induction characteristics as a result of pressure change in the cylinder. The method of sensing will now be described.

A first method of detecting the induction characteristic changes in the spark plug shell is known as the passive sensing technique. With this method, the flux change due to the permeability change generates a signal voltage in the sensing coil 17. This voltage is proportional to the time rate of change of pressure. This signal is then integrated to produce a cylinder pressure waveform. Thus passive technique detects dynamic pressure changes.

A second method of detecting the cylinder pressure changes involves active sensing. In this method, an oscillator is attached to the sensing winding 17, via the engine control unit 24 and circuit interface 4, and drives the sensing winding with a frequency at least ten times that of the pressure signal content; 100 KHZ has been shown to be a sufficient frequency. The frequency or amplitude of this signal is modulated in response to the induction property changes of the spark plug shell in response to pressure changes in the cylinder. Specifically, the resonant frequency shifts as the pressure changes in the cylinder. The shift in resonant frequency is a direct indication of pressure change. The control unit detects the change in resonant frequency from the sensing winding signal. The control unit generically refers to the engine control, communication and processing units associated with modem internal combustion engines as is understood within the art. The control unit provides the source and control of the voltage to the coils, communication with the sensing winding, as well as connection of the oscillator to the sensing winding. Circuit interface 4 may provide separate connection of the coil and pressure sensor to the control unit.

Figure 3:
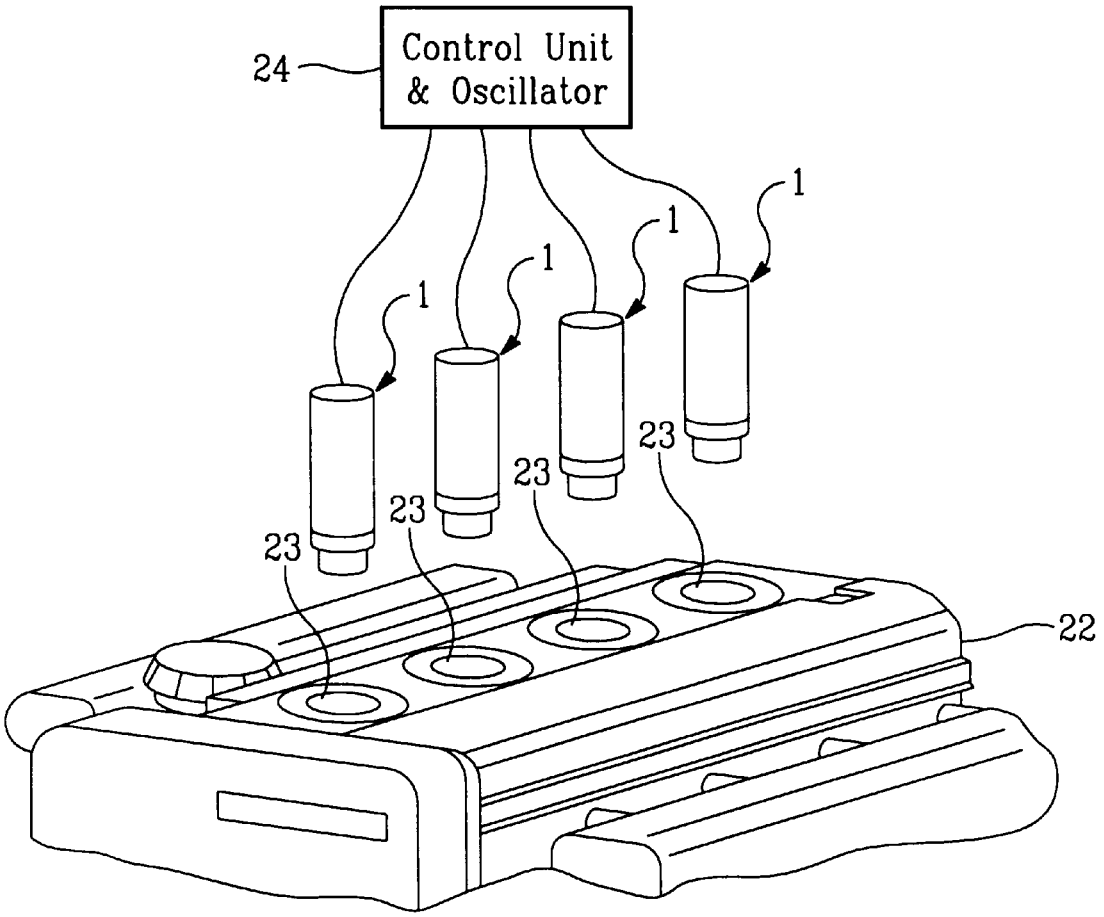
FIG. 3 is an exploded view of the integrated spark plug coil with pressure sensor together with an engine and a control unit of the present invention.

FIG. 3 depicts several integrated spark plug coil and pressure assemblies 1 connected to a plug hole 23 of an engine 22. The assemblies are in turn connected to the engine control unit 24 that may include an oscillator to drive the sensing windings in the active sensing method described above.

The combined spark plug, coil, and pressure sensor assembly provides a convenient means to manage combustion on an individual cylinder basis. A number of engine management options are enabled by thus pressure information. These include, but are not limited to, knock control, location of peak pressure control, torque based engine management, misfire detection and pressure ratio management.

Additionally, according to the present invention, the configuration of the case of the ignition coil for an internal combustion engine was preferably made to be circular, but the present invention is not exclusively restricted to this, and an axial cross-sectional configuration formed in a tubular configuration which is pentagonal, octagonal, or otherwise polygonal is also acceptable.

Still further, according to the present invention, the ignition coil for an internal combustion engine was mounted in a plug hole formed in an engine head cover, but the present invention is not exclusively restricted to this, and an ignition coil for an internal combustion engine which is mounted via a bracket or the like installed on an engine head cover is also acceptable.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A spark plug coil and pressure sensor assembly for providing a spark to a cylinder of an internal combustion engine and measuring pressure characteristics within said cylinder, said assembly comprising:

an outer housing;

a control circuit interface portion connected to a first end of said outer housing;

at least one coil disposed within said outer housing, said at least one coil adapted to be connected to a voltage source through said interface to selectively energize said at least one coil;

a spark plug shell connected to a second end of said outer housing and electrically connected to said at least one coil, said spark plug shell adapted to provide a spark when said at least one coil is energized;

a pressure sensor assembly connected to said outer housing proximate said spark plug shell, said pressure sensor adapted to sense pressure changes in said cylinder, said pressure assembly including a sensing winding wrapped around a sensing spool formed on a coil case disposed within said outer housing, said sensing winding being connected to said circuit control interface via a flex circuit;

wherein, said outer housing, said control circuit interface portion, said at least one coil, said spark plug shell and said pressure assembly are formed as an integrated assembly.

2. The spark plug coil and pressure sensor assembly according to claim 1, wherein said flex circuit includes lead lines extending from said sensing winding to said circuit control interface and a base ground plane disposed between said lead lines and said at least one coil to insulate said lead lines from said at least one coil.

3. The spark plug coil and pressure sensor assembly according to claim 1, wherein said pressure assembly further comprises a biasing magnet disposed adjacent said sensing winding to provide an initial flux through said sensing winding.

4. The spark plug coil and pressure sensor assembly according to claim 3, wherein said biasing magnet is a radially polarized annular ring disposed about a magnetostictive portion extending from said spark plug shell.

5. The spark plug coil and pressure sensor assembly according to claim 4, wherein said magnetostrictive portion of said spark plug shell is formed of a nickel-alloy plated steel.

6. The spark plug coil and pressure sensor assembly according to claim 1, in combination with a control unit of said internal combustion engine, wherein said control unit includes an oscillator, said oscillator being connected to said sensing winding for driving said sensing winding at a predetermined frequency.

7. A spark plug shell in combination with a pressure sensor for sensing pressure in a cylinder of an internal combustion engine, said spark plug shell comprising:

a magnetostrictive portion formed on said spark plug shell and adapted to be connected to a spark plug hole of said cylinder of said internal combustion engine, said magnetostrictive portion having a substantially cylindrical portion extending from said plug hole of said internal combustion engine when connected thereto;

said pressure sensor comprising;

a sensing winding wrapped about said substantially cylindrical portion of said magnetostrictive portion; and a substantially annular biasing magnet disposed about said substantially cylindrical portion of said magnetostrictive portion adjacent said sensing winding; wherein, said biasing magnet is radially polarized to induce an initial flux through said sensing winding, and said sensing winding produces a signal voltage in response to flux changes induced by pressure changes within said cylinder.

8. An integrated spark plug coil and pressure sensor assembly for providing a spark to a cylinder of an internal combustion engine and measuring pressure characteristics within said cylinder, said assembly comprising:

an outer housing formed as a longitudinally extending round tube;

a control circuit interface portion connected to a first end of said outer housing;

at least one coil disposed within said round tube, said at least one coil adapted to be connected to a voltage source through said interface to selectively energize said at least one coil;

a spark plug shell connected to a second end of said outer housing and having a magnetostrictive portion disposed within said round tube, said spark plug shell being electrically connected to said at least one coil, said spark plug shell adapted to provide a spark when said at least one coil is energized;

a pressure sensor assembly disposed within said round tube adjacent said magnetostrictive portion of said spark plug shell, said pressure sensor adapted to sense pressure changes in said cylinder, wherein, said round tube, said control circuit interface portion, said at least one coil, said spark plug shell and said pressure assembly are formed as an integrated assembly.

* * * * *